United States Patent [19]

Engel

[11] 4,130,246

[45] Dec. 19, 1978

[54] APPARATUS FOR THE EXTRACTION OF DIE-CAST PARTS FROM THE MOLDS OF DIE-CASTING MACHINES

[76] Inventor: Werner Engel, Ringstrasse 13, 3502 Vellmar 2, Fed. Rep. of Germany

[21] Appl. No.: 800,035

[22] Filed: May 24, 1977

[51] Int. Cl.[2] ..... B05B 3/18

[52] U.S. Cl. ..... 239/186; 239/289; 214/1 BC; 214/1 BD

[58] Field of Search ..... 214/1 BB, 1 BC, 1 BD, 214/147 T, 151; 239/186, 187, 289; 425/222

[56] References Cited

U.S. PATENT DOCUMENTS

| | | | |
|---|---|---|---|
| 3,051,328 | 8/1962 | Brown et al. | 214/1 BC |
| 3,246,847 | 4/1966 | Hammelmann | 239/187 |
| 3,476,266 | 11/1969 | Devol | 214/1 BB |
| 3,488,692 | 1/1970 | Masanadioda et al. | 214/1 BC |
| 3,819,061 | 6/1974 | Andersson et al. | 214/1 BB |

*Primary Examiner*—John J. Love
*Attorney, Agent, or Firm*—McCormick, Paulding & Huber

[57] ABSTRACT

An apparatus for extracting hot die-cast work pieces from a die-casting machine includes a gripping device for gripping newly completed work pieces from the mold halves and a mechanism for moving the gripping device from between the mold halves to a delivery station in such a manner as to reduce the space normally required by other extracting apparatuses. The gripping device moves both axially and pivots about two different axes in moving from its work piece receiving position and its work piece delivery position. A spray head sprays a release agent onto the mold halves while the mold halves are open and is also moved in a space saving manner.

4 Claims, 2 Drawing Figures

APPARATUS FOR THE EXTRACTION OF DIE-CAST PARTS FROM THE MOLDS OF DIE-CASTING MACHINES

The invention relates to an apparatus for the extraction of the hot die-cast parts from the casting moulds of die-casting machines by means of a gripping device insertable into the machine between its mould halves, and mounted on the end of a supporting arm which is movable from the extracting position into a delivery position located outside the area of the machine.

Extraction apparatuses of the type in question are known in the most varied embodiments. They are erected next to the die-casting machines and have the drawback that they either require an undue amount of space, particularly in a transverse direction to the die-casting machine, or they are of a complicated construction which frequently gives rise to breakdowns. A further disadvantage of the previously known extraction apparatuses results from the fact that the gripping devices only operate in one plane transverse to the plane of the die-casting machine, which results in the above-mentioned need for space and makes it necessary to place the die-casting machines at a relatively great distance apart from one another, which again causes other difficulties, e.g. as regards feeding the machines.

The task on which this invention is based is to construct the extracting apparatuses of the type in question in a space-saving manner and to render possible the delivery of the workpieces taken from the casting moulds in a place by which the required space in a traverse direction to the die-casting machine is not unnecessarily increased.

To solve this task, it is proposed according to the invention to construct an apparatus for the extraction of the hot die-cast parts from the casting moulds of die-casting machines in such a way that the arm supporting the gripping device is mounted in a sleeve in which it can move axially backwards and forwards, that the sleeve is pivotally mounted on a support about an axis at right-angles to its longitudinal axis, and that the support is mounted about a horizontal axis resting on a bearing block of the apparatus frame, so as to be tiltable from its horizontal pick-up position into a vertical discharge or delivery position. Through such a construction of the extracting apparatus it is possible to erect the apparatus relatively close to the die-casting machine. Because the workpiece picked up by the gripping device and drawn out of the machine is swung upwards by about 90° and can be swung downwards to one side or the other in a plane parallel to the die-casting machine and there deposited, the space required by the device constructed according to the invention is considerably less than for most devices of a comparable type.

Since it is desirable to sprinkle the surfaces of the casting moulds with a release agent after every use, in order to ensure an easier release of the workpieces from the mould, spray heads of a means for spraying a release agent are usually inserted into the space between the opened moulds after the die-cast piece has been released from the mould. In a logical further embodiment of the subject matter of the invention, it is proposed that adjacent to the extraction device of the apparatus an arm bearing a spray head of a release agent spraying means is mounted in a sleeve where it can move axially backwards and forwards, and that the sleeve is mounted about a horizontal axis resting on a bearing block of the apparatus frame, so as to be tiltable from its vertical rest position into its horizontal operating position.

Preferably the spray head is mounted so as to be pivotal about the axis of its supporting arm.

In general the movable parts of the extraction apparatus constructed according to the invention can be moved with the aid of any known drive unit; however, it has proved to be particularly advantageous to provide hydraulic servomotors, since these make possible the regulation of the speeds of motion, the accelerations and the delays, in a simple and expedient manner.

In FIGS. 1 and 2 of the drawing, the subject matter of the application is shown by means of a particularly preferred embodiment, which is described below in greater detail.

Figure 1:
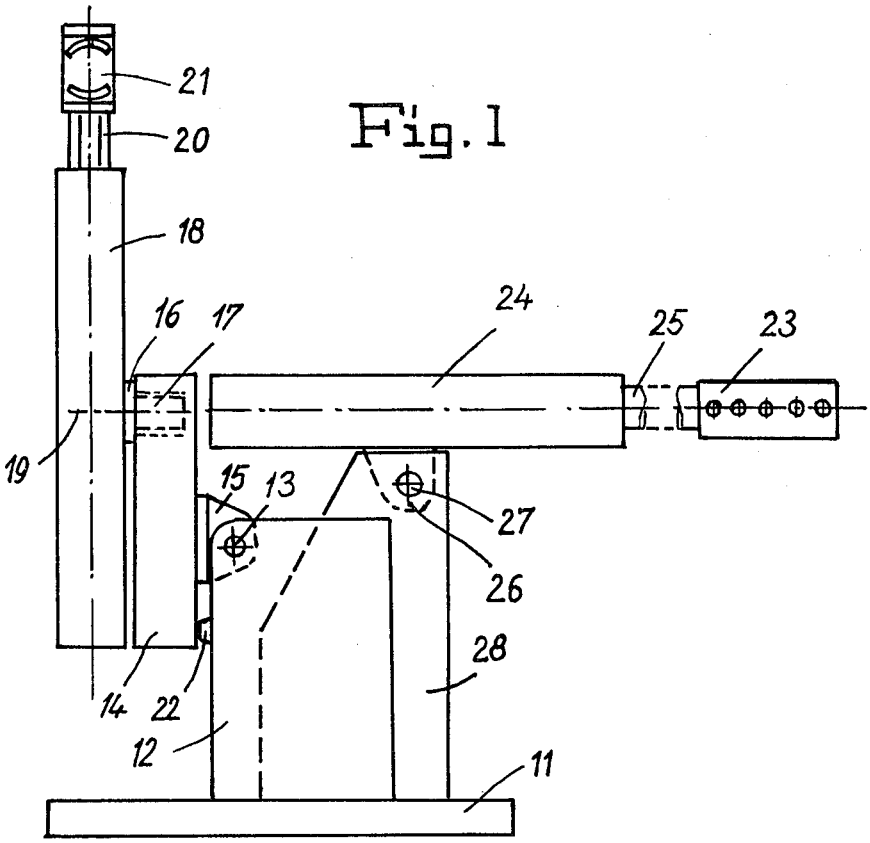
FIG. 1 shows a lateral view of an apparatus constructed according to the invention for extracting the hot die-cast parts from the casting mould of a die-casting machine, being at the same time equipped with a device for sprinkling the casting moulds with a release agent.
Figure 2:
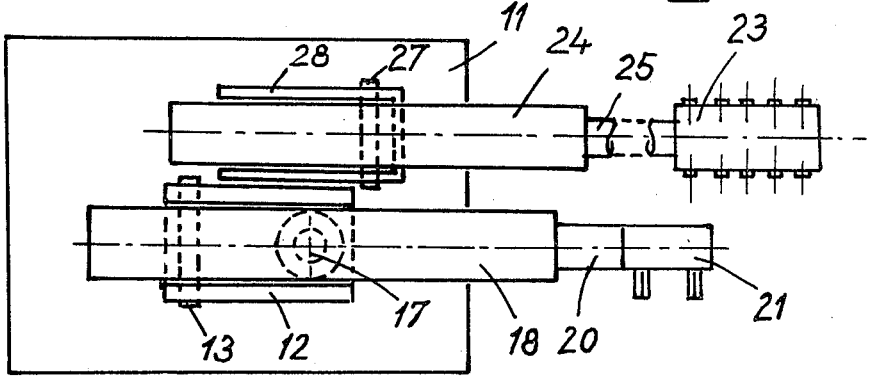
FIG. 2 shows a plan view of the extracting apparatus according to FIG. 1.

As can be seen from the drawing, on the base plate 11 of the extracting device a bearing block 12 is disposed, which carries in its upper area the pivot axis 13, on which the support 14 is mounted by its bearing boss 15. The support 14 is pivotable about the axis 13 between its vertical and its horizontal position. At the end which is upmost in the vertical position, the support 14 carries a socket 16, which takes the journal pins 17 of the sleeve 18, which is swivel-mounted on the support 14 about the axis 19. The supporting arm 20 is mounted in the sleeve 18 so as to be axially movable, and at its forward free end it carries the gripping device 21, which grips the hot die-cast part to remove it from the casting mould of the die-casting machine after the gripping device has been brought into the removal position. In this position, the support 14 and the sleeve 18 lie horizontally, so that the supporting arm 20 with the gripping device 21 can be inserted between the halves of the casting mould. After gripping the hot die-cast part and releasing it from the casting mould, the supporting arm with the gripping device holding the workpiece is moved axially backwards and thus out of the machine, and then tilted upwards by about 90°. After the support 14 has completed its tilting movement and reached the upright position, whereby it comes to rest against the stop 22 on the bearing block 12, the sleeve 18 is swivelled about the axis 19 towards one side or the other in a plane parallel to that of the die-casting machine, in order to deposit the workpiece held by the gripping device.

In order to sprinkle the surfaces of the casting mould of the die-casting machine with a release agent, the spray head 23 of a spraying means is inserted between the halves of the casting mould in a way analagous to the gripping device. To achieve this, the spray head 23 rests on a carrier arm 25 which is mounted so as to be movable axially backwards and forwards in a sleeve 24. The sleeve 24 is mounted with its bearing boss 26 on the pivot axis 27 on the bearing block 28, which is attached to the base plate 11 immediately adjacent to the bearing block 12. The sleeve 24 supporting the carrier arm 25 with the spray head 23 is tilted into its horizontal position in order to use the spraying means. The spray head can be inserted between the casting mould halves and be operated immediately after the extraction of the workpiece from the casting mould, so that the die-casting machine is more quickly prepared for the production of the next workpiece. After the mould has been sprayed, the spray head 23 is withdrawn and tilted with its carrier arm 25 by the sleeve 24 about the axis 27 into its horizontal rest position. To tilt the support 14 and the sleeve 24, as well as to swivel the sleeve 18 relative to the support 14 and to move the carrier arms 20 and 25 backwards and forwards, and where necessary to swivel the spray head 23, hydraulic drive units of a conventional construction are used.

What is claimed is:

1. An extracting apparatus for extracting hot die-cast parts from the casting mold halves of a die-casting machine, said apparatus comprising: a bearing block adapted to be positioned adjacent a die-casting machine, a sleeve, a carrier arm supported by said sleeve for axial sliding movement relative thereto along a slide axis running longitudinally of said arm, a gripping device mounted on said carrier arm for gripping work pieces from the mold halves of the die-casting machine with which it is associated and for removing such work pieces to a delivery station as a result of movement of said carrier arm, a support between said bearing block and said sleeve, means pivotally connecting said support to said bearing block for movement of said support relative to said bearing block between first and second positions approximately 90° from one another and about a horizontal first pivot axis, means pivotally connecting said sleeve to said support for movement of said sleeve relative to said support about a second pivot axis which is generally vertical when said support is in said first position and generally horizontal when said support is in said second position whereby when said sleeve and carrier arm are positioned generally horizontally and in a plane perpendicular to said horizontal first pivot axis said sleeve and carrier arm may be rotated in a first vertical plane to a vertical position by movement of said support relative to said bearing block about said horizontal first pivot axis and may then be rotated in a second vertical plane perpendicular to said first vertical plane to a new horizontal position by movement of said sleeve relative to said support about said second pivot axis.

2. An extracting apparatus according to claim 1 further characterized by a base carrying said bearing block, a second bearing block carried by said base adjacent said first-mentioned bearing block, a sleeve pivotally connected to said second bearing block for movement relative thereto about another axis parallel to said first axis between a first position at which the longitudinal axis of said sleeve is horizontal and a second position at which said longitudinal axis of said sleeve is vertical, a spray arm carried by said sleeve for axial sliding movement relative to said sleeve along its longitudinal axis, and a spray head carried by said spray arm for spraying a release agent onto the mold halves of the die-casting machine with which said extracting apparatus is associated.

3. An extracting apparatus according to claim 2 further characterized by means swivel-mounting said spray head for rotation about said longitudinal axis of said sleeve.

4. An extracting apparatus according to claim 1 further characterized by hydraulic drive units for moving its parts relative to one another.

* * * * *